US005211503A

United States Patent [19]

Quittner

[11] Patent Number: 5,211,503

[45] Date of Patent: May 18, 1993

[54] BARRIER GATE FOR LONGITUDINAL HIGHWAY BARRIER

[75] Inventor: John P. Quittner, Castle Cove, Austria

[73] Assignee: Energy Absorptions Systems, Inc., Chicago, Ill.

[21] Appl. No.: 690,515

[22] Filed: Apr. 24, 1991

[51] Int. Cl.[5] ..... E01F 13/00; A01D 46/00

[52] U.S. Cl. ..... 404/6; 56/13.1

[58] Field of Search ..... 404/6; 56/1, 13.1; 49/49

[56] References Cited

U.S. PATENT DOCUMENTS

| | | | |
|---|---|---|---|
| 1,370,689 | 7/1921 | Hearn | 49/33 |
| 1,759,207 | 5/1930 | Rose et al. | 49/33 |
| 2,024,063 | 12/1935 | Roper | 49/131 |
| 3,086,430 | 4/1963 | Emmel . | |
| 3,775,912 | 12/1973 | Walls | 49/131 |
| 4,231,190 | 11/1980 | Tieben | 49/25 |
| 4,322,914 | 4/1982 | McGaughey . | |
| 4,367,975 | 11/1983 | Tyers | 49/49 |
| 4,475,313 | 10/1984 | Governale . | |
| 4,490,068 | 12/1984 | Dickinson | 404/6 |
| 4,500,225 | 2/1985 | Quittner . | |
| 4,576,509 | 3/1986 | Beaty, Sr. . | |
| 4,624,601 | 11/1986 | Quittner . | |
| 4,630,395 | 12/1986 | Nasatka | 404/6 |
| 4,632,598 | 12/1986 | Richards | 404/9 X |
| 4,690,583 | 9/1987 | Faulconer | 404/6 |
| 4,699,197 | 10/1987 | Hamrick | 404/6 |
| 4,705,426 | 11/1987 | Perea | 404/6 |
| 4,708,515 | 11/1987 | Davies | 404/6 |
| 4,752,152 | 6/1988 | Crisp et al. | 160/188 |
| 4,762,439 | 8/1988 | Carlyle | 49/49 X |
| 4,775,261 | 10/1988 | Fladung | 49/49 X |
| 4,818,136 | 4/1989 | Nasatka et al. | 404/6 |
| 4,850,737 | 7/1989 | Nasatka et al. | 404/6 |
| 4,881,845 | 11/1989 | McKay | 404/6 |
| 4,893,119 | 1/1990 | Nasatka | 404/6 X |
| 4,989,835 | 2/1991 | Hirsch . | |
| 5,009,542 | 4/1991 | Hardin et al. | 404/6 |
| 5,028,463 | 7/1991 | Cahill et al. | 404/6 X |

FOREIGN PATENT DOCUMENTS

| | | | |
|---|---|---|---|
| 8229 | 8/1991 | Australia . | |
| 0241256 | 10/1987 | European Pat. Off. . | |
| 2838637 | 4/1979 | Fed. Rep. of Germany . | |
| 3606158 | 8/1987 | Fed. Rep. of Germany | 49/49 |
| 3611372 | 10/1987 | Fed. Rep. of Germany | 49/49 |
| 7212157 | 3/1974 | Netherlands . | |
| 158884 | 5/1957 | Sweden | 49/131 |
| 908805 | 10/1962 | United Kingdom . | |
| 2014220 | 2/1979 | United Kingdom . | |

OTHER PUBLICATIONS

"Guide for Selecting, Locating, and Designing Traffic Barriers". American Association of State Highway and Transportation Officials, p. 96 (1977).

"Roadside Design Guide", American Association of State Highway and Transportation Officials, pp. 6–11 (Oct. 1988).

*Primary Examiner*—Ramon S. Britts
*Assistant Examiner*—Nancy P. Connolly
*Attorney, Agent, or Firm*—Willian Brinks Olds Hofer Gilson & Lione

[57] ABSTRACT

A barrier gate for a longitudinal highway barrier of the type having first and second axially aligned barrier segments separated by a gap includes two elongated gates. These gates are mounted by rails and wheels for axial movement between an opened position in which the gates reveal the gap, and a closed position, in which the gates close the gap. The gates are designed to fit over and straddle the adjacent barrier segments, and are provided with a sidewall configuration that matches the shape of the barrier segments to eliminate snagging surfaces.

18 Claims, 3 Drawing Sheets

G
10
12
14
16
18
20
22
24
26
28
30
32
34
36
38
40
42
44
46
60
61
62
64
66
68
70
72
74
76
S1
S2

FIG.6
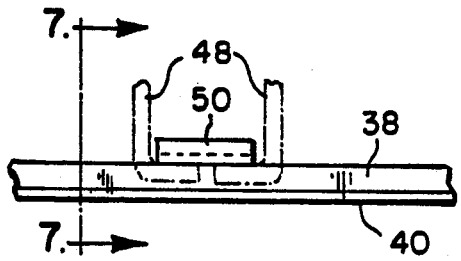
FIG.7
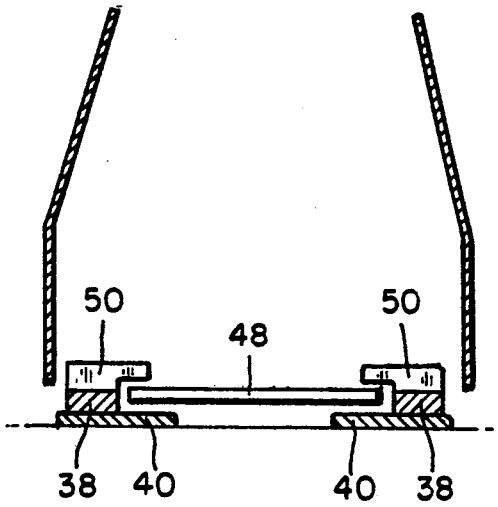
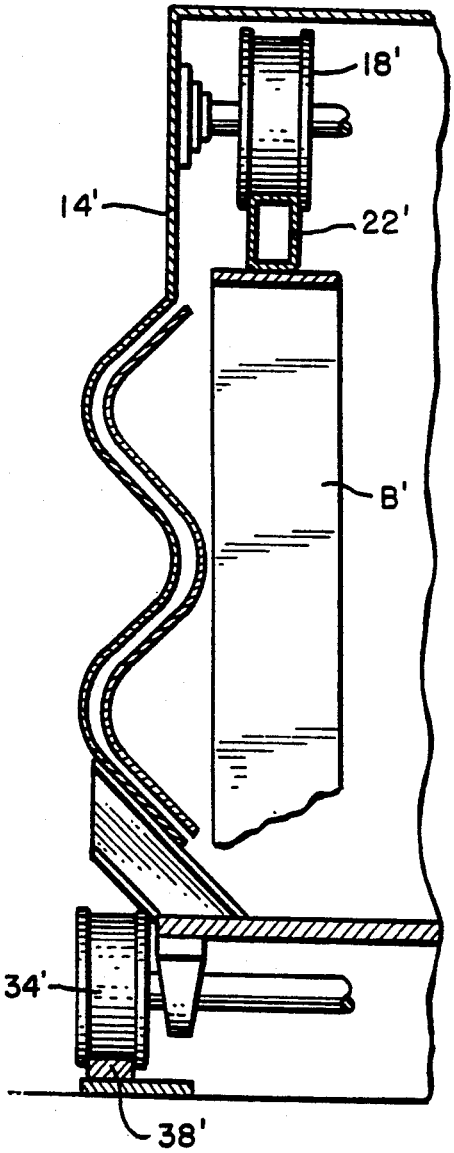
FIG.8

BARRIER GATE FOR LONGITUDINAL HIGHWAY BARRIER

BACKGROUND OF THE INVENTION

This invention relates to a barrier gate of the type that can be used to open and close a gap between first and second axially aligned highway barrier segments positioned adjacent a lane of traffic.

Hardin U.S. patent application Ser. No. 07/489,346, filed Mar. 6, 1990, discloses two barrier gates of the general type described above. The first includes pivoted panels that are designed to move outwardly as the gate is lowered, thereby converting the gate from an obstruction into a ramp to allow emergency vehicles to cross the highway barrier through the gap. The second provides a gate receiving well in the gap between the barrier segments, along with a motor driven linkage for rotating the gate and lowering it into the well when it is desired to open the gap.

There are applications in which the designs of the Hardin patent application have drawbacks. For example, the first design requires a width substantially greater than that of the barrier segment to allow the barrier gate to fold outwardly as it is lowered. In some applications this additional lateral space may not be available. The second design requires a well, and may require means for draining the well to prevent it from filling with water. This may be particularly important in locations where water in the well may freeze and obstruct lowering of the gate.

The present invention is directed to an improved barrier gate which substantially overcomes these potential disadvantages, and which provides a particularly simple design which eliminates the need for receiving wells and which requires little width beyond that of the highway barrier segments themselves.

SUMMARY OF THE INVENTION

According to this invention, a barrier gate is provided for a longitudinal highway barrier of the type having at least first and second axially aligned barrier segments separated by a gap therebetween. This barrier gate comprises an elongated gate, means for mounting the gate in alignment with the first barrier segment such that the gate extends along an axis defined by the first barrier segment, and means for translating the gate between a first position, in which at least a portion of the gate overlaps the first barrier segment axially and reveals at least a portion of the gap, and a second position, in which at least a portion of the gate is positioned in the gap to extend toward the second barrier segment, thereby closing at least a portion of the gap. The translating means comprises a motor mounted adjacent one end of the gap, a drive wheel mounted to engage the gate to move the gate axially past the drive wheel, and a drive member interconnecting the motor and the drive wheel.

As described below, in the preferred embodiment the gate telescopes over the adjacent barrier segments when the gate is opened. The gate is moved in a simple linear motion which can be implemented in a low cost and reliable manner. The gate does not protrude to any substantial extent beyond the highway barrier segments, whether in the opened or closed position, and receiving wells and the need for mechanisms to drain such receiving wells are completely avoided.

BRIEF DESCRIPTION OF THE DRAWINGS

FIG. 7 is a cross-sectional view taken along line 7—7 of FIG. 6.

FIG. 8 is a partial cross-sectional view of a second preferred embodiment of this invention.

DETAILED DESCRIPTION OF THE PRESENTLY PREFERRED EMBODIMENTS

Figure 1B:
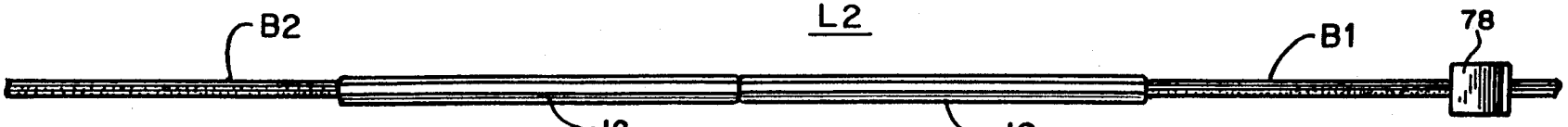
FIG. 1*b* is a plan view of the embodiment of FIG. 1*a*.
Figure 1A:
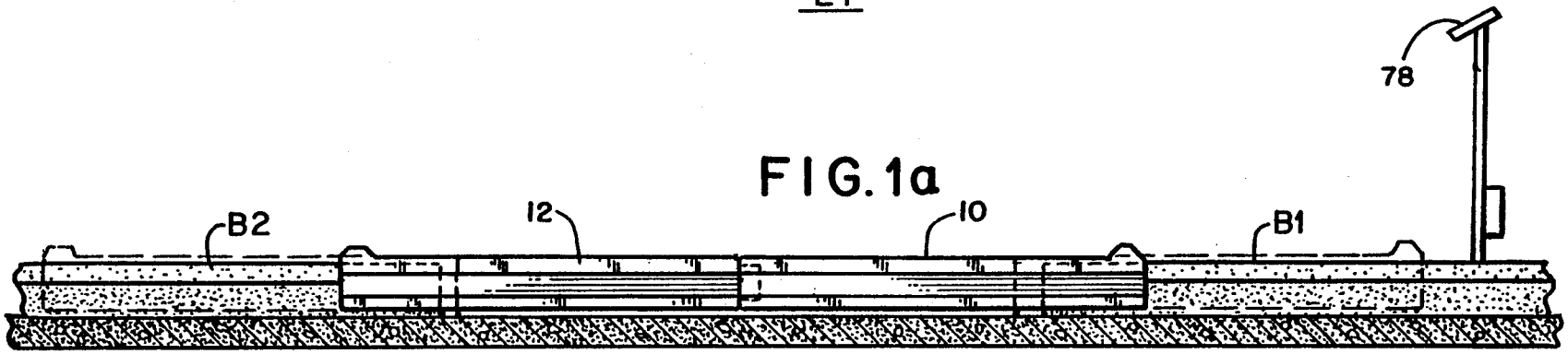
FIG. 1*a* is a side elevational view of a first preferred embodiment of this invention.

Turning now to the drawings, FIGS. 1*a* and 1*b* show a first preferred embodiment of this invention. This embodiment includes first and second elongated gates 10, 12, each mounted to and in axial alignment with a respective highway barrier segment B1, B2. The highway barrier segments B1, B2 are positioned between two lanes L1, L2 of highway traffic. FIG. 1*a* shows the gates 10, 12 in the closed position in solid lines, while dash lines are used to indicate the position of the gates 10, 12 when in the opened position.

Figure 2A:
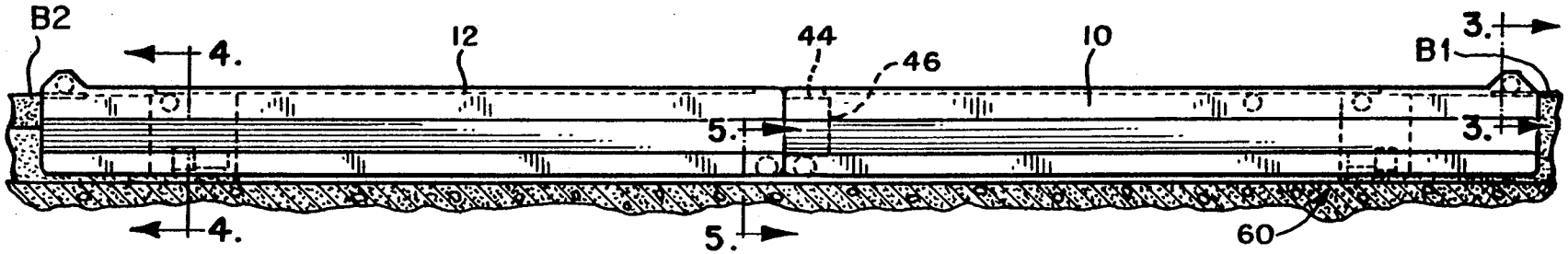
FIG. 2*a* is a side elevational view of the embodiment of FIG. 1*a* in the closed position.
Figures 2B, 3, 4, 5, 6:
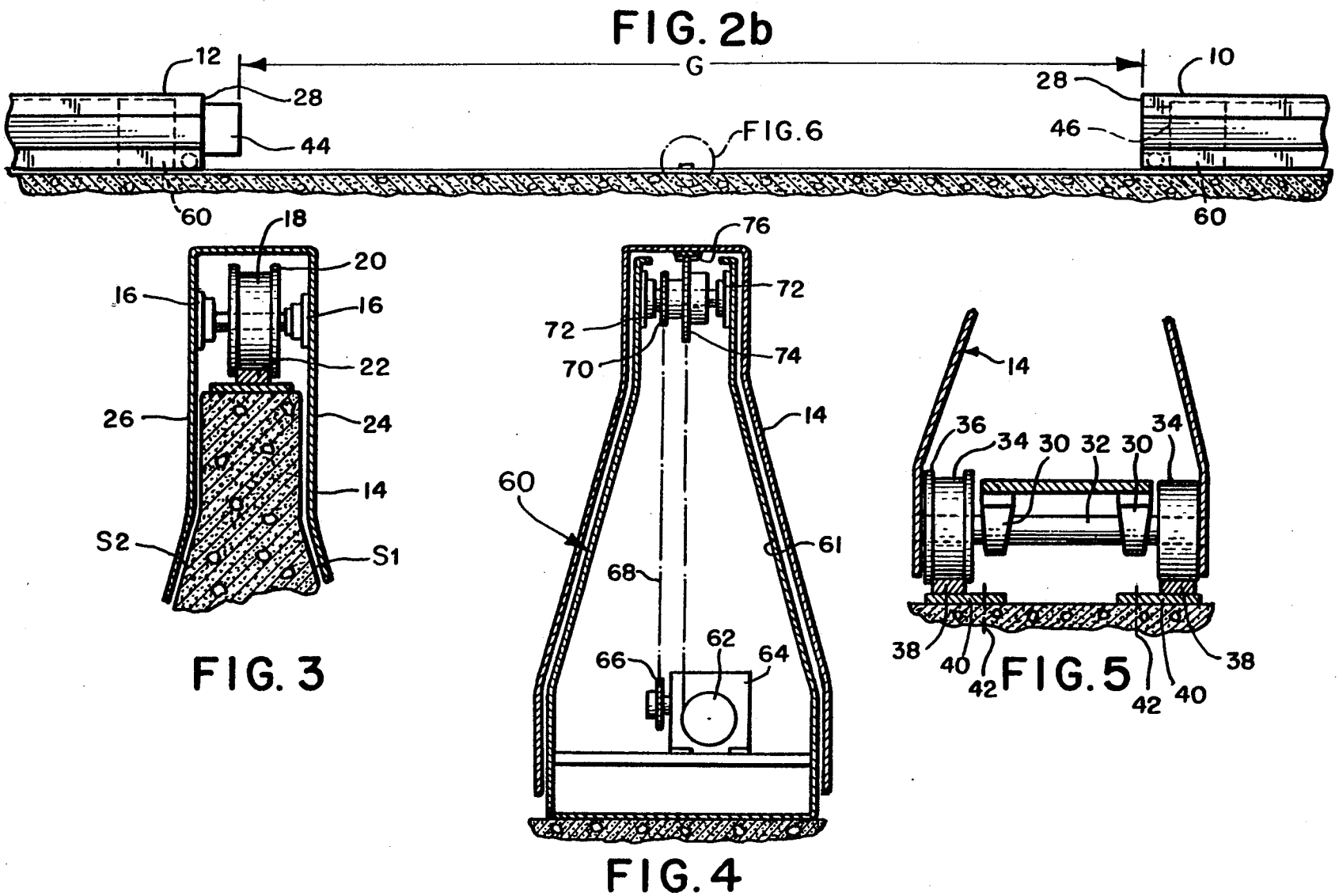
FIG. 2*b* is a side elevational view of the embodiment of FIG. 1*a* in the opened position.
FIG. 3 is a cross-sectional view taken along line 3—3 of FIG. 2*a*.
FIG. 4 is a cross-sectional view taken along line 4—4 of FIG. 2*a*.
FIG. 5 is a partial cross-sectional view taken along line 5—5 of FIG. 2*a*.
FIG. 6 is an enlarged detail of the encircled region 6 of FIG. 2*b*.

FIGS. 2*a* and 2*b* show side elevational views of the gates 10, 12 in the closed position (FIG. 2*a*) and in the opened position (FIG. 2*b*).

The gates 10, 12 are mounted for translational movement as shown in detail in FIGS. 3 and 5. With certain exceptions described below, the gates 10, 12 are substantially identical in construction, and the following discussion applies to both gates unless otherwise indicated.

As shown in FIG. 3, each gate includes an outer shell 14 which is preferably substantially rigid and shaped to conform to and fit over the adjacent barrier segment. FIG. 3 shows the barrier segment as a conventional concrete barrier having axially extending sides S1, S2. The shell 14 defines sides 24, 26 which generally match the configuration of the sides S1, S2. The upper portion of the shell 14 supports journals 16 which in turn support a wheel 18 for free rotation. This wheel 18 is provided with radially extending circumferential flanges 20. The wheel 18 is supported on a rail 22 which is fixed in place to an upper surface of the barrier segment. Thus, the wheel 18 supports the end of the gate adjacent the barrier segment as the wheel 18 translates along the length of the rail 22.

The distal end 28 of each of the gates is also supported for longitudinal motion by means of rails and wheels, as shown in FIG. 5. The shell 14 supports journals 30 which in turn rotatably support a shaft 32. The shaft 32 has mounted on it a pair of wheels 34, at least one of which defines flanges 36 as described above. The wheels 34 are positioned to ride along rails 38 that are rigidly mounted on spacers 40. The spacers 40 are secured by ground anchors 42 to a support surface, which can typically be a concrete pad. The spacers 40 should preferably be discontinuous, with gaps therebetween in order to allow adequate drainage from the region between the rails 38. The wheels 18, 34 are allowed to rotate freely, and thus the gates 10, 12 can be rolled between the closed position of FIG. 2*a* and the opened position of FIG. 2*b*, guided by the rails 22, 38. The flanges 20, 36 hold the gates 10, 12 in axial alignment, and ensure proper tracking.

Returning to FIGS. 2*a* and 2*b*, the gate 10 defines a mortise 46 and the gate 12 defines a tenon 44. The tenon 44 is shaped and positioned to be received in the mortise 46 such that, when the gates 10, 12 are in the closed position shown in FIG. 2*a*, the mechanical interlock provided by the mortise 44 and the tenon 46 provides additional support to the gates 10, 12 against lateral movement.

Further reinforcement is provided for the gates 10, 12 as shown in FIGS. 6 and 7. Each of the gates 10, 12 defines a tongue 48 mounted on the distal end to engage a retainer 50 that is secured in place on the rails 38. These tongues 48 resist any tendency of the gates 10, 12 to move laterally or to be lifted in an impact, and positively retain the flanges 36 in engagement with the rails 38.

The axial position of the gates 10, 12 is controlled by a drive mechanism positioned inside a pair of drive modules 60. One of the drive modules 60 is positioned at the end of each of the barriers B1, B2 adjacent the gap G (FIG. 2*b*). FIG. 4 shows further details regarding one of the drive modules 60.

Each of the drive modules 60 includes an outer housing 61 that is shaped to conform to the adjacent barrier segment B1, B2 such that the drive module 60 appears as an extension of the adjacent barrier segment B1, B2. As shown in FIG. 4, mounted within the housing 61 is an electric motor 62 which drives a sprocket 66. The sprocket 66 drives a drive member such as a chain 68 which rotates an upper sprocket 70 mounted on journals 72 to the housing 61. A drive pinion 74 is mounted to rotate in unison with the sprocket 70, and this drive pinion 74 has a toothed outer edge portion that is positioned to engage a drive rack 76 which extends axially along the upper portion of the shell 14. When the motor 62 rotates the sprocket 66, the chain 68 rotates the sprocket 70 and the drive pinion 74, thereby moving the shell 14 axially.

If desired, a solar collector 78 (FIG. 1*a*) can be provided to charge a battery (not shown) that provides power for the motor 62. A variety of control mechanisms can be provided for the motor 62, depending on the application. For example, radio controlled circuits can be provided to allow an emergency vehicle to command the motor 62 to open or close the gates 10, 12. Details of construction regarding such a control system do not per se form part of this invention and are therefore not disclosed in greater detail.

The following details of construction are provided in order to clarify the presently preferred embodiment of this invention. It should clearly be understood that these details are intended only by way of illustration, and do not in way limit the scope of this invention.

In this preferred embodiment, the length of the gap between the barrier segments is 39 feet 6 inches, and the length of the opening between the gates 10, 12 in the opened position is 32 feet. The drive module 60 has an axial length of 2 feet, and when the gates 10, 12 are in the closed position of FIG. 2*a* there is a 6 foot overlap between the proximal end of the gate 10, 12 and the adjacent barrier segment B1, B2. This embodiment has been designed for barrier segments B1, B2 that provide at least an 81 foot straight length to allow for motion of the gates 10, 12 to the opened position. Of course, this invention is not limited to gates which operate along a straight section of a highway barrier as shown. The same principles can be used to construct arcuate gates designed to function along a smoothly curved stretch of highway barrier.

By way of example, the shell 14 may be fabricated of 154" mild steel, which is sufficiently rigid to withstand glancing impacts. The shell 14 may be provided with an end plate that defines the mortise 46, and the tenon 44 may also be formed of mild steel, suitably tapered to ensure that the tenon 44 will slide into the mortise 46. The wheels 18, 34 may be formed of cast iron, and preferably only one of the wheels 34 is flanged in each gate 10, 12. This eliminates the need for highly precise track placement. The motor 62 may be a 12 volt ¼ horsepower motor operating at 30 rpm powered by a 30 amp-hour nickel cadmium battery charged by the solar collector 78. If desired the drive pinion 74 may be formed as a sprocket and the drive rack 76 may be formed as a chain.

The disclosed embodiment has been designed for use with a concrete barrier having a tapering configuration. It should be understood that this invention is not limited to use with such concrete barriers, and it can readily be adapted to barriers of other configurations. FIG. 8 shows one alternative design for a barrier B' that supports an upper rail 22'. This barrier B' has a side surface that is shaped in a corrugation of the type generally used for guard rails. The shell 14' of this embodiment is supported by wheels 18', 34'. The wheel 18' rolls on a rail 22', and the wheel 34' rolls on a rail 38' as described above. This second embodiment is similar to the first in that the shell 14' is designed to telescope over the adjacent barrier segment B', and the general configuration of the shell 14' matches that of the adjacent barrier segment B'.

Because the side configurations of the shells 14, 14' match those of the adjacent barrier segments B1, B2, B', the embodiments described above do not provide snagging surfaces of the type that may impart undesired accelerations to an impacting vehicle. As described above, the gates 10, 12 are preferably sufficiently rigid so that they do not deform excessively when struck by an impacting vehicle so as to create snagging surfaces. This rigidity is enhanced by the mortise 44 and tenon 46 described above, as well as the tongue 48 and retainer 50. When closed as shown in FIG. 2*a*, the gates 10, 12 form a continuation of the adjacent barrier segments B1, B2. Impacting vehicles are substantially prevented from snagging, and the chance that an impacting vehicle may pass through the gap G is substantially eliminated. Of course, when the gates 10, 12 are opened as shown in FIG. 3, an emergency vehicle can pass through the gap G without obstruction.

It should be understood that a range of changes and modifications can be made to the preferred embodiments described above. It is therefore intended that the foregoing detailed description be regarded as illustrative rather than limiting, and that it be understood that the invention is defined by the following claims, including all equivalents.

I claim:

1. A barrier gate for a longitudinal highway barrier of the type having at least first and second axially aligned barrier segments separated by a gap therebetween, said barrier gate comprising:

an elongated gate;

means for mounting the gate in alignment with said first barrier segment such that the gate extends toward the second barrier segment along an axis defined by the first barrier segment; and means for translating the gate along the axis between a first position, in which at least a portion of the gate overlaps the first barrier segment along the axis and reveals at least a portion of the gap, and a second position, in which at least a portion of the gate is positioned in the gap to extend along the axis toward the second barrier segment, thereby closing at least a portion of the gap;

said translating means comprising a motor mounted adjacent one end of the gap, a drive wheel mounted to engage the gate to move the gate axially past the drive wheel, and a drive member interconnecting the motor and the drive wheel.

2. The invention of claim 1 wherein said first barrier segment defines first and second axially extending sides, and wherein the gate is shaped to fit over the first barrier segment when in the first position and to cover a portion of the first and second sides situated under the gate.

3. The invention of claim 2 wherein the mounting means comprises:

a first rail situated on an upper portion of the first barrier segment;

a second rail situated in the gap;

first and second wheels rotatably mounted on the gate to engage the first and second rails, respectively, such that the wheels support the gate on the rails and the wheels move along the rails as the gate moves between the first and second positions.

4. The invention of claim 3 wherein each of the wheels defines a respective flange positioned to engage the respective rail to maintain the gate in alignment with the first barrier segment.

5. The invention of claim 1 further comprising means for engaging an end of the gate remote from the first barrier segment when the gate is in the second position to reinforce the gate against lateral movement.

6. A barrier gate for a longitudinal highway barrier of the type having at least first and second axially aligned barrier segments separated by a gap therebetween, said barrier gate comprising:

first and second elongated gates;

means for mounting the first gate in alignment with the first barrier segment such that the first gate extends toward the second barrier segment along an axis defined by the first barrier segment;

means for mounting the second gate in alignment with the second barrier segment such that the second gate extends toward the first barrier segment along the axis;

means for translating the first and second gates along the axis between a first position, in which at least a portion of the first and second gates overlap the first and second barrier segments, respectively, along the axis to reveal at least a portion of the gap, and a second position, in which at least portions of the first and second gates are positioned in the gap to extend toward one another along the axis, thereby closing at least a portion of the gap;

said translating means comprising two motors, each mounted adjacent a respective end of the gap, two drive wheels, each mounted to engage the respective gate to move the respective gate axially past the respective drive wheel, and two drive members, each interconnecting the respective motor and drive wheel.

7. The invention of claim 6 wherein said barrier segments each define first and second axially extending sides, and wherein the gates are shaped to fit over the respective barrier segments when in the first position and to cover a portion of the first and second sides situated under the gates.

8. The invention of claim 6 wherein the mounting means comprises:

a pair of first rails, each situated on an upper portion of a respective one of the barrier segment barriers;

a second rail situated in the gap;

a plurality of wheels rotatably mounted on each of the gates to engage the first and second rails such that the wheels support the gates on the rails and the wheels move along the rails as the gates move between the first and second positions.

9. The invention of claim 8 wherein each of the wheels defines a respective flange positioned to engage the respective rail to maintain the gate in axial alignment.

10. The invention of claim 6 further comprising means for engaging the first and second gates one with the other when the gates are in the second position to reinforce the gates against lateral motion.

11. The invention of claim 10 wherein the engaging means comprises a mortise formed in the first gate and a tenon formed in the second gate, said mortise configured and positioned to receive the tenon when the first and second gates are in the second position.

12. The invention of claim 6 wherein the gates each define a distal end remote from the respective barrier segments, and wherein the invention further comprises means for releasably engaging the distal ends with a ground anchor when the gates are in the second position to brace the gates against lateral movement.

13. The invention of claim 6 wherein each of the gates is shaped to provide an outer configuration that substantially matches the respective barrier segment.

14. A barrier gate for a longitudinal highway barrier of the type having at least first and second axially aligned barrier segments separated by a gap therebetween, said barrier gate comprising:

first and second elongated gates;

a telescoping mounting arrangement operative to mount the first gate in alignment with the first barrier segment such that the first gate is movable along an axis defined by the first barrier segment;

a telescoping mounting arrangement operative to mount the second gate in alignment with the second barrier segment such that the second gate is movable along an axis defined by the second barrier segment;

a drive mechanism coupled to the first and second gates to translate the first and second gates between a first position, in which at least portions of the first and second gates axially overlap the first and second barrier segments, respectively, to reveal at least a portion of the gap, and a second position, in which at least portions of the first and second gates are positioned in the gap to extend toward one another, thereby closing the gap;

said drive mechanism comprising two motors, each mounted adjacent a respective end of the gap, two drive wheels, each mounted to engage the respective gate to move the respective gate axially past the respective drive wheel, and two drive members, each interconnecting the respective motor and drive wheel.

15. The invention of claim 14 further comprising means for engaging the first and second gates one with the other when the gates are in the second position to reinforce the gates against lateral motion.

16. The invention of claim 15 wherein the engaging means comprises a mortise formed in the first gate and a tenon formed in the second gate, said mortise configured and positioned to receive the tenon when the first and second gates are in the second position.

17. The invention of claim 14 wherein each of the gates defines a distal end remote from the respective barrier segment, and wherein the invention further comprises means for releasably engaging the distal ends with a ground anchor when the gates are in the second position to brace the gates against lateral movement.

18. The invention of claim 14 wherein each of the gates is shaped to provide an outer configuration that substantially matches the respective barrier segment.

* * * * *

UNITED STATES PATENT AND TRADEMARK OFFICE

CERTIFICATE OF CORRECTION

PATENT NO. : 5,211,503

DATED : May 18, 1993

INVENTOR(S) : Quittner

It is certified that error appears in the above-identified patent and that said Letters Patent is hereby corrected as shown below:

On the title page: Item [75] Inventors:

In line 2, please delete "Austria" and substitute therefor --Australia--.

In Column 4, line 11, please delete "154" and substitute therefore --3/8--.

Signed and Sealed this

Twelfth Day of April, 1994

Bruce Lehman

*Attest:*

BRUCE LEHMAN

*Commissioner of Patents and Trademarks*

*Attesting Officer*